US008794550B2

(12) United States Patent
Kaneko et al.

(10) Patent No.: US 8,794,550 B2
(45) Date of Patent: Aug. 5, 2014

(54) FUEL INJECTION VALVE

(75) Inventors: Naoya Kaneko, Susono (JP); Nobuyuki Shimizu, Gotenba (JP); Hiroyuki Sakai, Gotenba (JP); Toshikuni Kurokawa, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/578,908

(22) PCT Filed: Mar. 5, 2010

(86) PCT No.: PCT/JP2010/053679

§ 371 (c)(1), (2), (4) Date: Aug. 14, 2012

(87) PCT Pub. No.: WO2011/108118

PCT Pub. Date: Sep. 9, 2011

(65) Prior Publication Data

US 2012/0305678 A1 Dec. 6, 2012

(51) Int. Cl.

| | |
|---|---|
| ***B05B 1/00*** | (2006.01) |
| ***B05B 1/14*** | (2006.01) |
| ***B05B 1/26*** | (2006.01) |
| ***B05B 1/30*** | (2006.01) |
| ***F02M 61/18*** | (2006.01) |

(52) U.S. Cl.

CPC ..... *F02M 61/1853* (2013.01); *F02M 61/1806* (2013.01); *F02M 61/1846* (2013.01); *F02M 61/186* (2013.01)

USPC ..... 239/596; 239/552; 239/585.1; 239/585.5; 239/601

(58) Field of Classification Search

CPC ..... F02M 61/1806; F02M 61/1846; F02M 61/1853; F02M 61/186

USPC ..... 239/533.2, 533.12, 548, 552, 585.1, 239/585.5, 596, 601

See application file for complete search history.

(56) References Cited

U.S. PATENT DOCUMENTS 5,383,597 A * 1/1995 Sooriakumar et al. ..... 239/5
5,772,124 A 6/1998 Tamaki et al.

(Continued)

FOREIGN PATENT DOCUMENTS

CN 101371033 A 2/2009
EP 1 816 344 A1 8/2007

(Continued)

OTHER PUBLICATIONS

International Search Report Issued May 18, 2010 in PCT/JP10/53679 Filed Mar. 5, 2010.

(Continued)

*Primary Examiner* — Ryan Reis

(74) *Attorney, Agent, or Firm* — Oblon, Spivak, McClelland, Maier & Neustadt, L.L.P.

(57) ABSTRACT

An fuel injection valve has: a needle housed in a valve body in a reciprocable manner; an injection hole plate attached to a front end portion of the valve body, the plate having an injection hole connecting an inside and an outside of the valve body; and a valve sheet which the needle is attached to or detached from so as to close or open a fuel flow path that reaches the injection hole of the injection hole plate through an outer circumference of the needle. The injection hole plate has a recessed portion dented in an axial direction of the needle so as to cause fuel flowing toward the injection hole through the valve sheet to descend lower than a height of an inlet port of the injection hole and then, to turn to ascension so as to reach the inlet port of the injection hole on the injection hole plate.

17 Claims, 12 Drawing Sheets

(56) References Cited

U.S. PATENT DOCUMENTS

| | | | | |
|---|---|---|---|---|
| 6,719,223 | B2 * | 4/2004 | Yukinawa et al. | 239/584 |
| 6,817,545 | B2 * | 11/2004 | Xu | 239/533.12 |
| 6,921,021 | B2 * | 7/2005 | Nally et al. | 239/5 |
| 6,929,196 | B2 * | 8/2005 | Togashi et al. | 239/533.14 |
| 7,124,963 | B2 * | 10/2006 | Goenka et al. | 239/504 |
| 7,198,207 | B2 * | 4/2007 | Goenka et al. | 239/533.12 |
| 2002/0100821 | A1 | 8/2002 | Yukinawa et al. | |
| 2004/0217207 | A1 | 11/2004 | Nally et al. | |
| 2004/0217208 | A1 | 11/2004 | Nally et al. | |
| 2004/0217213 | A1 | 11/2004 | Nally et al. | |
| 2009/0057446 | A1 | 3/2009 | Hung et al. | |
| 2009/0090794 | A1 | 4/2009 | Hung et al. | |
| 2009/0230219 | A1 | 9/2009 | Matsumura et al. | |
| 2010/0224705 | A1 | 9/2010 | Hashii et al. | |
| 2011/0260084 | A1 | 10/2011 | Hashii et al. | |

FOREIGN PATENT DOCUMENTS

| | | |
|---|---|---|
| JP | 9 32695 | 2/1997 |
| JP | 2002 227748 | 8/2002 |
| JP | 2005 282420 | 10/2003 |
| JP | 2005 155547 | 6/2005 |
| JP | 2007 182767 | 7/2007 |
| JP | 2007 309236 | 11/2007 |
| JP | 2008 121517 | 5/2008 |
| WO | WO 2004/063556 A2 | 7/2004 |
| WO | 2008 117459 | 10/2008 |

OTHER PUBLICATIONS

Extended European Search Report issued May 8, 2013 in Patent Application No. 10847020.4.

* cited by examiner

FUEL INJECTION VALVE

TECHNICAL FIELD

The present invention relates to a fuel injection valve in which an injection hole plate in which injection holes are formed is mounted to a front end of a valve body.

BACKGROUND ART

There is a known fuel injection valve in which injection holes are inclined toward inlet ports of the injection holes in a direction opposite to a flowing direction of a fuel flowing on an injection hole plate (Patent literature 1). There is also a known fuel injection valve in which an injection hole plate is shaped such that its central part is protruded and injection holes are formed in an inclined portion around the protruded portion (Patent literature 2). Patent literature 3 exists as a conventional technical literature related to the present invention.

CITATION LIST

Patent Literatures

Patent literature 1 Japanese Patent Application Laid-Open No. 9-32695

Patent literature 2 Japanese Patent Application Laid-Open No. 2008-121517

Patent literature 3 Japanese Patent Application Laid-Open No. 2007-309236

SUMMARY OF INVENTION

Technical Problem

In the fuel injection valve in Patent literature 1, since the injection holes are inclined with respect to the fuel advancing direction, fuel is sharply bent when being led by the injection holes. Thereby, as separation of fuel is promoted, the fuel could be atomized. It could be forecasted that the extent of atomization is improved by increasing this inclination angle. However, as the inclination angle increases, it becomes more difficult to form the injection holes. Thereby, there is such a problem that manufacturability is degraded. Further, since in the fuel injection valve in Patent literature 2, the fuel flow is sharply bent in a process that the fuel passes over the inclined portion and led to the injection holes, the fuel injection valve also contributes to the fuel atomization. However, there are difficulties in manufacturing in a process of protruding the injection hole plate and in a formation of the injection holes in the inclined portion of the injection hole plate.

Thus, an object of the present invention is to provide a fuel injection valve that could atomize fuel without degrading manufacturability.

Solution to Problem

A fuel injection valve according to the present invention includes: a needle housed in a valve body in a reciprocable manner; an injection hole plate attached to a front end portion of the valve body, the injection hole plate having at least one injection hole connecting an inside and the outside of the valve body; and a valve sheet which the needle is attached to or detached from so as to close or open a fuel flow path that reaches the injection hole in the injection hole plate through an outer circumference of the needle, wherein the injection hole plate has a recessed portion dented in an axial direction of the needle so as to cause fuel flowing toward the injection hole through the valve sheet to descend lower than a height of an inlet port of the injection hole and then, to turn to ascension so as to reach the inlet port of the injection hole on the injection hole plate, wherein the injection hole plate has the injection hole at a position separated from a center outward in the radial direction with respect to the injection hole plate, and the inlet port of the injection hole has a difference of altitude such that a side closer to the center is lower than a side further from the center.

In this fuel injection valve, since the fuel entering the recessed portion, after ascending, is led to the injection hole, even when an inclination angle of the injection hole is not made large, it is ensured that the fuel flow direction is changed to promote fuel peeling. Further, in this fuel injection valve, even when the inclination angle of the injection hole is relatively small, an adequate effect can be obtained, and the recessed portion formed in the injection hole plate can be easily formed according to a well-known method such as cutting and electro-discharge machining. Thus, fuel atomization can be achieved without degrading manufacturability. In addition, since the recessed portion is shaped such that the fuel moving toward the injection hole descends lower than the height of the inlet port of the injection hole on the injection hole plate, the fuel entering the recessed portion can be disturbed while descending. This can contribute to fuel atomization.

Further, since the injection hole is formed at a position separated from a center outward in the radial direction with respect to the injection hole plate, and the inlet port of the injection hole has the difference of altitude such that the side closer to the center is lower than the side further from the center, it is possible to prevent a portion of the fuel flowing toward the inlet port of the injection hole from colliding against a wall surface of the injection hole on the side closer to the center of the injection hole plate. Thus, since excessive amount of fuel can be suppressed from being led into the injection hole, thinning of the fuel flowing along the inner wall surface of the injection hole can be promoted. Due to this fuel thinning, the fuel is easily atomized.

Any method of giving the difference of altitude to the inlet port may be adopted. For example, the difference of altitude may be given by forming on the injection hole plate a groove leading to the injection hole on the side closer to the center. In this case, advantageously, it is relatively easy to give an accurate difference of altitude by processing of the groove.

As one aspect of the fuel injection valve according to the present invention, the recessed portion may be arranged such that a boundary portion between an upper surface of the injection hole plate and the recessed portion is located on an extension of a contact surface between the valve sheet and the needle. In this case, further, the recessed portion may have a side wall surface that connects the boundary portion to a bottom portion, and the contact surface and the side wall surface have the same inclination as each other. According to this aspect, when the fuel passing through the valve sheet enters the recessed portion, the flow is easily maintained and therefore, a decrease in the fuel flow rate can be suppressed. Further, most of the fuel entering the recessed portion collies against the bottom portion of the recessed portion and gives rise to disturbance. Accordingly, as compared to the case where the fuel collides against the injection hole plate at a position away from the recessed portion, the position where disturbance occurs due to collision can be made closer to the injection hole.

As one aspect of the fuel injection valve according to the present invention, the recessed portion and the injection hole may be arranged in the injection hole plate with a predetermined distance therebetween, and thereby a straight portion may be formed between the recessed portion and the injection hole. According to this aspect, since the straight portion is formed between the recessed portion and the injection hole, the fuel which has turned to ascension by the recessed portion passes through the straight portion before being reaching the injection hole. This can increase a fuel peeling distance. Moreover, since a certain thickness between the injection hole and the recessed portion can be ensured, a decrease in strength is prevented and manufacturing is facilitated.

As one aspect of the fuel injection valve according to the present invention, the injection hole plate may have a plurality of injection holes, and the recessed portion may extend in the circumferential direction of the injection hole plate so as to surround the plurality of injection holes. In this case, even when the fuel flows from any position in the circumferential direction of the injection hole plate toward the injection holes, since the recessed portion surrounds the plurality of injection holes, a uniform effect can be obtained.

As one aspect of the fuel injection valve according to the present invention, the injection hole plate may have an inner injection hole group where a plurality of injection holes are arranged in the circumference direction of the injection hole plate and an outer injection hole group where a plurality of injection holes are arranged on an outer side of the inner injection hole group in the circumference direction, and one type of divided recessed portions and another type of divided recessed portions may be provided as the recessed portion, wherein one type of divided recessed portions are arranged between the inner injection hole group and the outer injection hole group so as to extend in the circumferential direction of the injection hole plate, the divided recessed portions intermittently extending in the circumferential direction while facing the injection holes in the inner injection hole group respectively, and the other type of divided recessed portions are arranged on an outer side of the outer injection hole group, the divided recessed portions intermittently extending in the circumferential direction facing the injection holes in the outer injection hole group respectively. Moreover, as one aspect of the fuel injection valve according to the present invention, the injection hole plate may have an inner injection hole group where a plurality of injection holes are arranged in the circumference direction of the injection hole plate and an outer injection hole group where a plurality of injection holes are arranged on an outer side of the inner injection hole group in the circumference direction, and as the recessed portion, an annular recessed portion may be arranged between the inner injection hole group and the outer injection hole group so as to extend the circumference direction of the injection hole plate, and also divided recessed portions may be arranged on an outer side of the outer injection hole group, the divided recessed portions intermittently extending in the circumferential direction facing the injection holes respectively.

When the fuel passes through the recessed portion, the flow rate decreases and peeling occurs. Because of this, in a case where the plurality of injection holes exist with different distances from the center of the injection hole plate, assumed that the recessed portion is formed so as to surround the outermost injection holes, the fuel led to the injection holes on the center side passes through the recessed portion and its flow rate decreases. Because of this, there is a possibility that atomization of the fuel injected from the injection holes on the center side is degraded. According to the aspect in which the divided recessed portions are provided as the recessed portion, since the recessed portions arranged on the outer side of the outer injection hole group are divided except for portions facing the injection holes in the outer injection hole group, the fuel led to the inner injection hole group passes through the divided portions and reaches the inner injection hole group through the divided recessed portions or the annular recessed portion with no affection by the recessed portions arranged on the outer side of the outer injection hole group. Accordingly, since the fuel atomization effect by the inner injection hole group is less degraded as compared to a case of the outer injection hole group, the atomization effects by the inner injection hole group and the outer injection hole group can be made uniform.

As one aspect of the fuel injection valve according to the present invention, the injection hole plate may have a plurality of injection holes, and the recessed portion may be arranged adjacent to each of the injection holes and be oriented to the center of the injection hole plate. According to this aspect, the effect by the recessed portions can be equally applied to the injection holes formed in the injection hole plate.

As one aspect of the fuel injection valve according to the present invention, the recessed portion may extend toward the center of the injection hole plate so as to have a larger radial length than a width in the circumferential direction of the injection hole plate. According to this aspect, since the elongated recessed portion extends toward the center of the injection hole plate, for example, when the injection hole is formed at a position closer to the center of the injection hole plate than the valve sheet, the fuel can be efficiently led to the injection hole formed at such position.

As one aspect of the fuel injection valve according to the present invention, a protrusion portion may be formed on the needle, the protrusion portion facing the recessed portion and protruding on a side of coming close to the injection hole plate. According to this aspect, the protrusion portion can equalize the height from the bottom portion of the recessed portion to the needle and the height from the upper surface of the injection hole plate to the needle. That is, expansion of the flow path area due to the recessed portion can be suppressed, thereby suppressing a decrease in flow rate. According to this aspect, the protrusion portion may have the same shape as the facing recessed portion. Since the protrusion portion has the same shape as the recessed portion, the above-mentioned equalization can be achieved substantially completely.

As one aspect of the fuel injection valve according to the present invention, the recessed portion may be formed in the injection hole plate such that a contour of the recessed portion on a side of the injection hole formed between the recessed portion and the upper surface of the injection hole plate conforms with an inlet port of the injection hole. According to this aspect, when the fuel passing through the recessed portion reaches the inlet port of the injection hole, almost same condition can be provided with respect to the circumferential direction of the injection hole and therefore, it is ensured that the fuel is peeled.

As one aspect of the fuel injection valve according to the present invention, the recessed portion may be formed in the injection hole plate such that a width with respect to the circumferential direction of the injection hole plate is gradually smaller as the width gets closer to the injection hole. According to this aspect, since the fuel entering the recessed portion is gradually narrowed toward the injection holes, fuel flow toward the injection holes can be enhanced. This increases a force of pressing the fuel onto the inner wall surface of the injection hole, which contributes to fuel thinning.

As one aspect of the fuel injection valve according to the present invention, a plurality of recessed portions with respect to one injection hole may be formed in the injection hole plate, and each of the plurality of recessed portions may extend toward the injection holes. Further, in this case, the plurality of recessed portions may be connected to each other on a side closer to the injection hole. According to these aspects since fuel that does not flow toward the inlet port of the injection hole can be collected at the injection hole by the plurality of recessed portions, the fuel can be efficiently injected.

The recessed portion may be formed in the injection hole plate such that a boundary portion between an upper surface of the injection hole plate and the recessed portion overlap the inlet port of the injection hole. According to this aspect, since the upper surface of the injection hole plate and the recessed portion becomes a part of the inlet port of the injection hole, the part becomes pointed toward the needle. As a result, since the portion causing fuel peeling is pointed, fuel peeling is enhanced and fuel atomization is further improved.

DESCRIPTION OF EMBODIMENTS

First Embodiment

Figure 1:
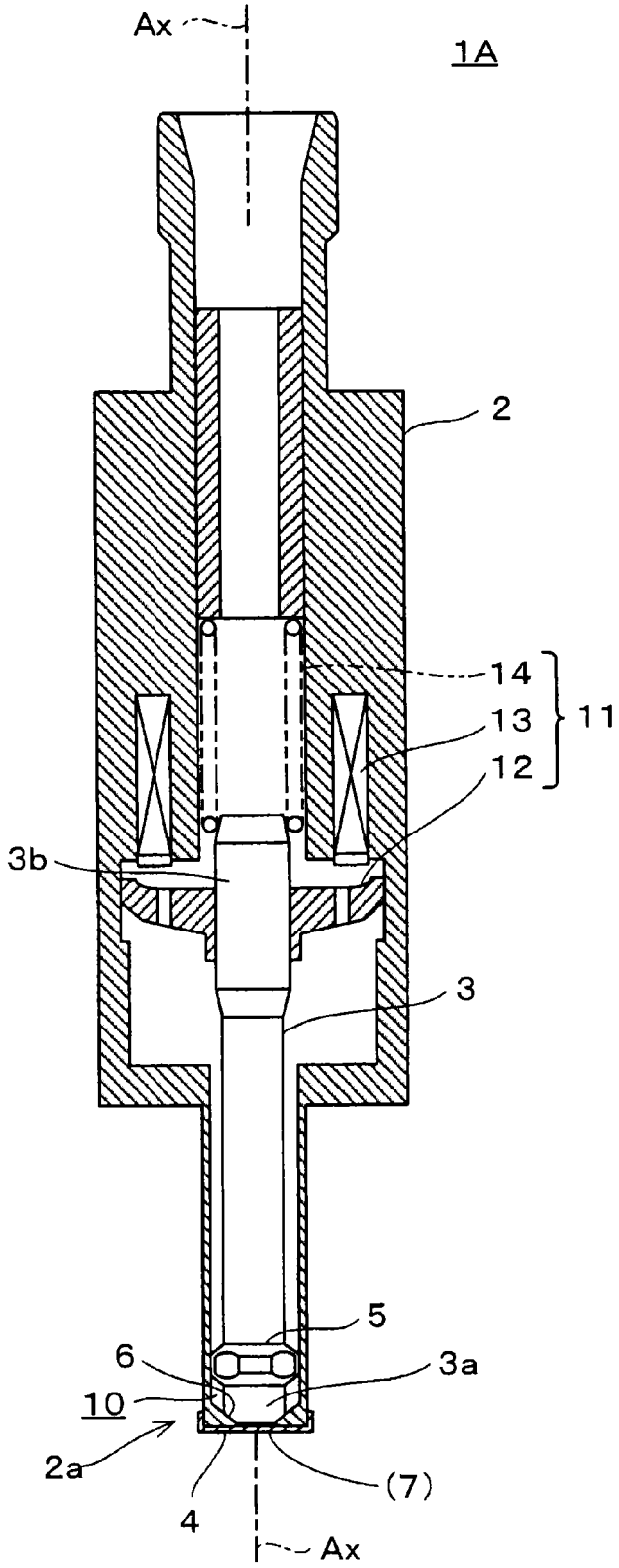
FIG. 1 is a view showing an overall configuration of a fuel injection valve according to the first embodiment of the present invention.

FIG. 1 shows an overall configuration of a fuel injection valve according to the first embodiment of the present invention. The fuel injection valve 1A is configured as an electromagnetically driven fuel injection valve which performs by being incorporated into a spark-ignited internal combustion engine. The fuel injection valve 1A includes a needle 3 housed in a valve body 2 in a reciprocable manner and an injection hole plate 4 attached to a front end portion 2*a* of the valve body 2. The needle 3 is supported by an inner circumferential surface of the valve body 2 and a needle guide 5 so as to be reciprocable along an axial line Ax. A front end portion 3*a* of the needle 3 is configured to be attached or detached with respect to a valve sheet 6 formed in the valve body 2. A plurality of injection holes 7 connected to the inside and the outside of the valve body 2 are formed in the injection hole plate 4. The needle 3 is attached or detached with respect to the valve sheet 6, thereby enabling a fuel flow path 10 that reaches the injection holes 7 via the outer circumference of the needle 3 to be closed or opened. A bottom end portion 3*b* of the needle 3 is connected to an electromagnetic driving device 11 housed in the valve body 2.

The electromagnetic driving device 11 includes an armature 12 fixed to the needle 3, an electromagnetic coil 13 excited by energization to suck the armature 12 and a coil spring 14 biasing the needle 3 to be pressed onto the valve sheet 6. By energization of the electromagnetic coil 13 of the electromagnetic driving device 11, the needle 3 is pulled up integrally with the armature 12 from the state of being pressed onto the valve sheet 6 by the coil spring 14. Thereby, the needle 3 is detached from the valve sheet 6 and the fuel flow path 10 is opened, thereby allowing fuel to be injected from the injection holes 7. When energization of the electromagnetic coil 13 is blocked, the coil spring 14 causes the needle 3 to be attached to the valve sheet 6, thereby closing the fuel flow path 10 and stopping fuel injection. The fuel injection amount and the fuel injection timing can be adjusted by appropriately operating the energization time and timing of the electromagnetic coil 13.

Figure 2:
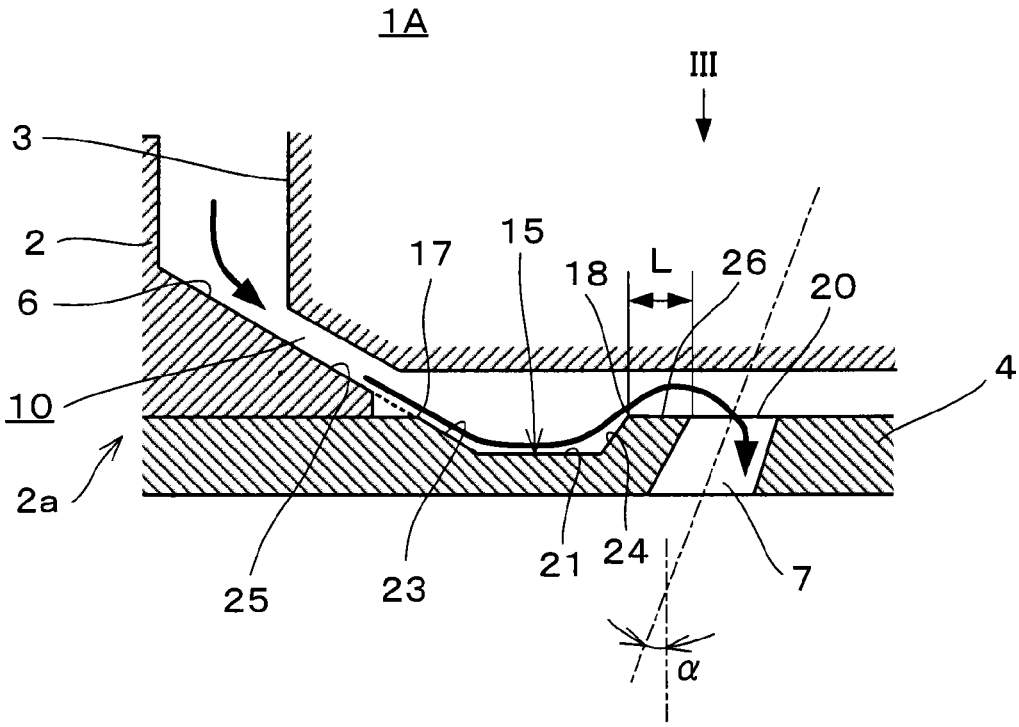
FIG. 2 is an enlarged sectional view of an injection hole plate and its surroundings thereof.
Figure 3:
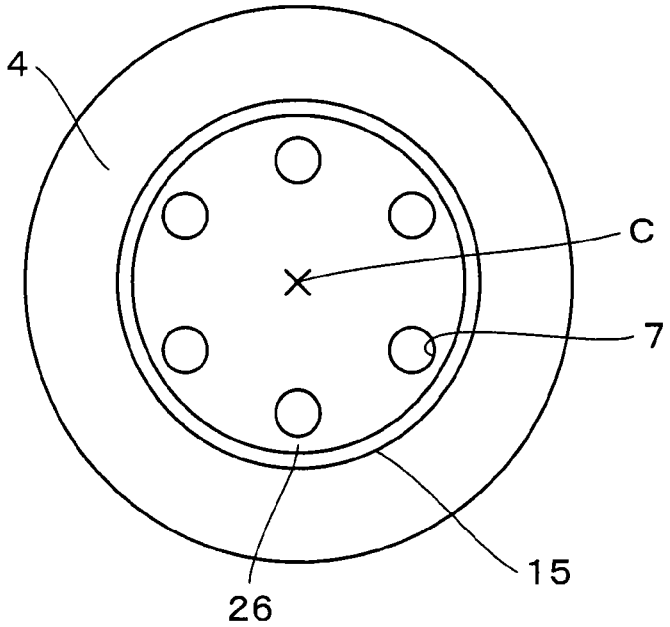
FIG. 3 is a plan view of the injection hole plate when viewed from an arrow III in FIG. 2.

FIG. 2 is an enlarged sectional view of the injection hole plate 4 and its surroundings, and FIG. 3 is a plan view of the injection hole plate 4 when viewed in a direction of an arrow III in FIG. 2. As seen in these figures, in addition to the injection holes 7, a recessed portion 15 dented in a vertical direction in FIG. 2 (the direction of the axial line Ax in FIG. 1) is formed in the injection hole plate 4. The recessed portion 15 is formed by cutting the injection hole plate 4. The recessed portion 15 extends in the circumferential direction of the injection hole plate 4 in an endless manner, that is, annularly, so as to surround the plurality of (six holes in this embodiment) injection holes 7 arranged with a constant distance from the center C of the injection hole plate 4 and at regular intervals in the circumferential direction. Because of this, even when fuel flows from any circumferential position of the injection hole plate 4 toward the injection holes 7, the equivalent effect can be obtained. That is, the fuel injection state from each of the injection holes 7 can be made uniform.

As apparent from FIG. 2, boundary portions 17, 18 between an upper surface of the injection hole plate 4 and the recessed portion 15 are located in the fuel flow path 10. Because of this, as represented by an arrow in FIG. 2, at the moment of going over the boundary portion 17 on the side of the valve sheet 6, the fuel that passes through the valve sheet 6 via the outer circumference of the needle 3 descends below a height of inlet ports 20 of the injection holes 7 on the injection hole plate 4. Then, the descended fuel flows along a flat bottom portion 21 and subsequently, turns to ascension toward the boundary portion 18 on the side of the injection holes 7 and reaches the inlet ports 20 of the injection holes 7.

Since the recessed portion 15 has such a sectional shape, the fuel flow direction can be bent in an acute angle manner immediately in front of the injection hole 7 as illustrated. Thereby, it is possible to promote fuel peeling. As well known, when fuel peeling of the fuel flowing toward the injection holes 7 is promoted, the fuel flowing along the inner circumferential surfaces of the injection holes 7 can be made thin. As a result, atomization of the fuel injected from the injection holes 7 is promoted. To achieve the effect caused by the recessed portion 15 only by adjusting the inclination angle of the injection holes provided in a flat injection hole plate, the inclination angle must be made much larger than the illustrated inclination angle $\alpha$. However, in this embodiment, due to the existence of the recessed portion 15, even when the inclination angle $\alpha$ is relatively small, a sufficient effect can be obtained. Since the recessed portion 15 can be formed according to a well-known processing method such as a cutting work as described above, manufacturability is not degraded. In addition, since the recessed portion 15 is shaped such that the fuel flowing toward the injection holes 7 descends once below the height of the inlet ports 20 of the injection holes 7 on the injection hole plate 4, it is possible to disturb the fuel to enter into the recessed portion 15 during its descent. This can contribute to the fuel atomization.

In the recessed portion 15 in this embodiment, as represented by a broken line in FIG. 2, the boundary portion 17 on the side of the valve sheet 6 is located on the extension of a contact surface 25 between the valve sheet 6 and the needle 3. A side wall surface 23 that connects the boundary portion 17 to the bottom portion 21 has the same inclination as the contact surface 25. Thus, when the fuel that passes through the valve sheet 6 flows into the recessed portion 15, the flow is easily maintained and therefore, the flow rate of the fuel can be prevented from decrease. In addition, most of the fuel flowing into the recessed portion 15 collides with the bottom portion 21 of the recessed portion 15, which generates disturbance. Accordingly, as compared to a case where the fuel collides with the injection hole plate 4 at a position further from the recessed portion 15 than the position as illustrated, the position where disturbance is generated by collision can be made closer to the injection holes 7. An angle of a side wall surface 24 that connects the boundary portion 18 on the side of the injection holes 7 to the bottom portion 21 can be arbitrarily set, and when the angle is set more vertically to the injection hole plate 4, the fuel peeling can be enlarged more than the case of illustrated.

Moreover, in this embodiment, since the recessed portion 15 and the injection holes 7 are arranged in the injection hole plate 4 with a predetermined distance therebetween, a flat straight portion 26 having a length L is formed between the recessed portion 15 and the injection holes 7. Thereby, the fuel that turns to ascension due to the recessed portion 15 passes through the straight portion 26 before reaching the injection holes 7, a fuel peeling distance can be increased. Further, since a certain thickness between the injection holes 7 and the recessed portion 15 is ensured, a decrease in strength is avoided and manufacturing is facilitated. The length L of the straight portion 26 can be easily set by adjusting the distance between the recessed portion 15 and the injection holes 7.

Second Embodiment

Next, The second embodiment of the present invention will be described with reference to FIG. 4. The second embodiment is the same as the first embodiment except for the shape of the needle. Because of this, the same components as those in the first embodiment are given the same reference numerals in this figure and descriptions thereof are omitted. Concerning the basic configuration of the second embodiment, FIG. 1 and the like is referred to as needed.

Figure 4:
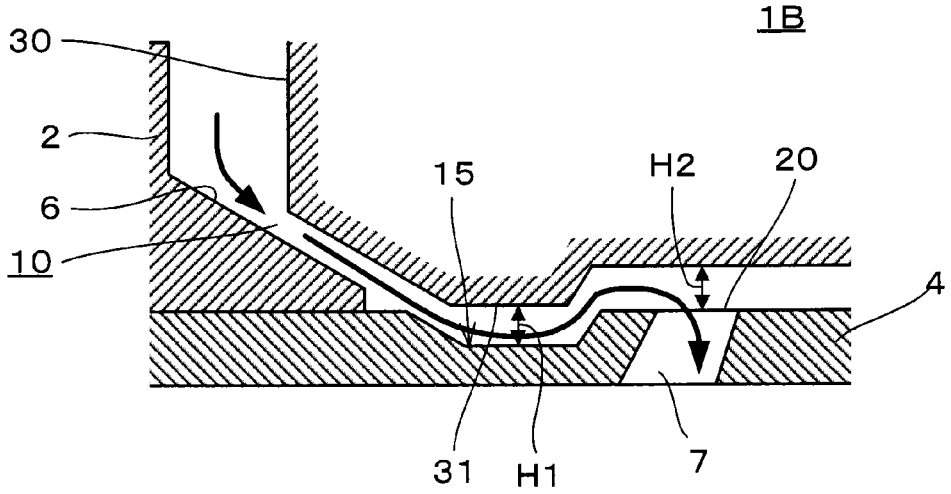
FIG. 4 is an enlarged sectional view of an injection hole plate and surroundings thereof according to the second embodiment

FIG. 4 is an enlarged sectional view of the injection hole plate and surroundings of a fuel injection valve in accordance with the second embodiment. As illustrated, the fuel injection valve 1B includes the needle 30. The needle 30 is provided with a protrusion portion 31 facing the recessed portion 15 and protruding on a side of coming close to the injection hole plate 4. A protruding amount of the protrusion portion 31 is controlled such that the protrusion portion 31 is hidden in the recessed portion 15 in an attaching state of the fuel injection valve 1B, and in a detaching state of the fuel injection valve 1B, the protrusion portion 31 is located at a height equally to or slightly lower than the upper surface of the injection hole plate 4.

As understood from FIG. 4, in the fuel injection valve 1B, because the needle 30 thereof is provided with the protrusion portion 31, a height H1 from the bottom portion 21 of the recessed portion 15 to the needle 30 can be made equal to a height H2 from the upper surface of the injection hole plate 4 to the needle 30. That is, the protrusion portion 31 can prevent a flow path area from expanding due to the recessed portion 15, thereby it is possible to suppress a reduction in the fuel flow rate. The protrusion portion 31 has the same shape as the recessed portion 15. That is, the protrusion portion 31 is annularly formed so as to match the recessed portion 15 shown in FIG. 3. Thereby, it is possible to achieve the above-mentioned equalization at any position in a circumferential direction.

Third Embodiment

Next, the third embodiment of the present invention will be described with reference to FIGS. 5 and 6. The third embodiment is obtained by partially modifying the first or second embodiment, and has the same configuration as these embodiments except for modified parts. Accordingly, descriptions of the same configuration as that in the first or second embodiment are omitted.

Figure 5:
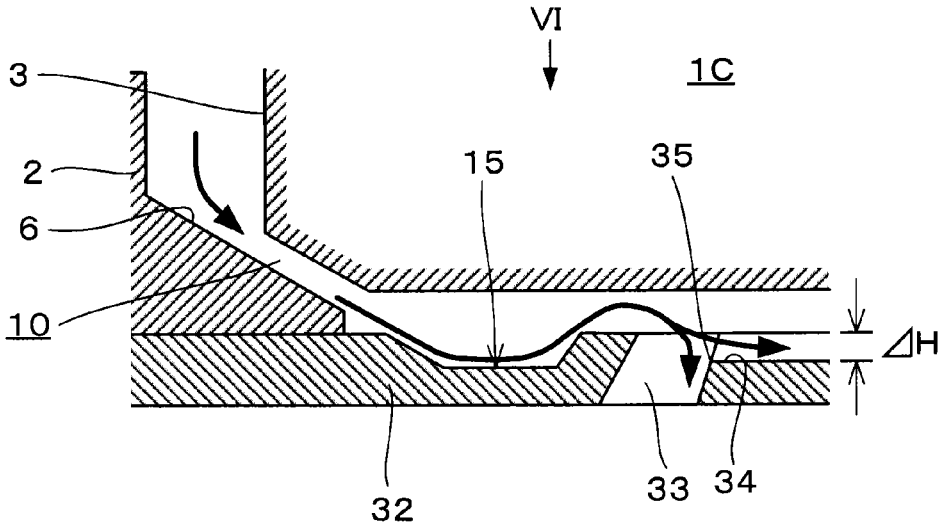
FIG. 5 is an enlarged sectional view of an injection hole plate and surroundings thereof according to the third embodiment.
Figure 6:
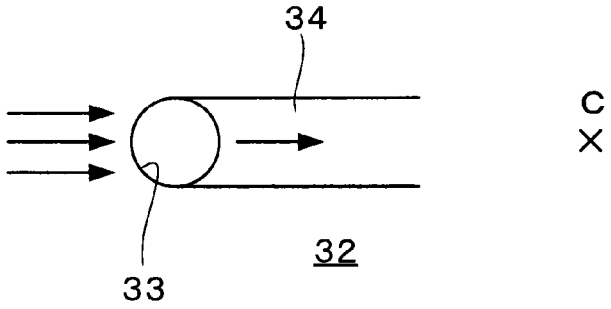
FIG. 6 is an explanatory view of the injection hole plate shown in FIG. 5 when viewed from an arrow VI.

FIG. 5 is an enlarged sectional view of an injection hole plate and surroundings of a fuel injection valve in accordance with the third embodiment, and FIG. 6 is an explanatory view of the injection hole plate shown in FIG. 5 when viewed in a direction of an arrow VI. As shown in these figures, the fuel injection valve 1C includes an injection hole plate 32 having injection holes 33, and the injection hole plate 32 is provided with grooves 34 leading to the injection holes 33. The groove 34 is leading to the injection hole 33 at a side closer to the center C of the injection hole plate 32. Because of this, the upstream side of the injection hole 33 is partially cut out. As a result, an inlet port 35 of each injection hole 33 has a difference of altitude ΔH such that the side closer to the center of the injection hole plate 32 is lower than the side further from the center.

Due to the difference of altitude ΔH, as shown by arrows in FIGS. 5 and 6, it can be avoided that a part of the fuel flowing toward the inlet port 35 of the injection hole 33 collides with the wall surface of the injection hole 33 on the closer side to the center C of the injection hole plate 32. By avoiding this collision, it is possible to suppress that the fuel is excessively led into the injection hole 33. Thereby, it is possible to promote thinning of the fuel injected from outlet port 36 of the injection hole 33. In this manner, the fuel is easily atomized. In this embodiment, since the difference of altitude ΔH is generated by processing of the grooves 34, it is relatively easy to achieve a highly accurate difference of altitude. However, forming the groove 34 to generate the difference of altitude ΔH is merely an example, and for example, a similar difference of altitude can be generated in the injection hole 33 by cutting the center of the injection hole plate 32 so as to interfere with the injection hole 33.

Modification Examples

The present invention is not limited to the above-mentioned embodiments but may be implemented in various embodiments. For example, there are variations of the injection hole plate in which the injection holes, the recessed portion and the like are formed as described below, and the variations can be applied to each of the above-mentioned embodiments to implement the present invention.

(1) Modification Example of Arrangement of Injection Holes and Recessed Portion in the Injection Hole Plate In First to Third embodiments, the number of the injection holes formed in the injection hole plate is six, and the injection holes are arranged with a uniform distance from the center of the injection hole plate in the circumferential direction. However, as shown in FIGS. 7A to 7I, the number and arrangement of the injection holes may be changed and the shape and arrangement of the recessed portion may be changed according to the changed arrangement of the injection holes.

First Modification Example

Figure 7A:
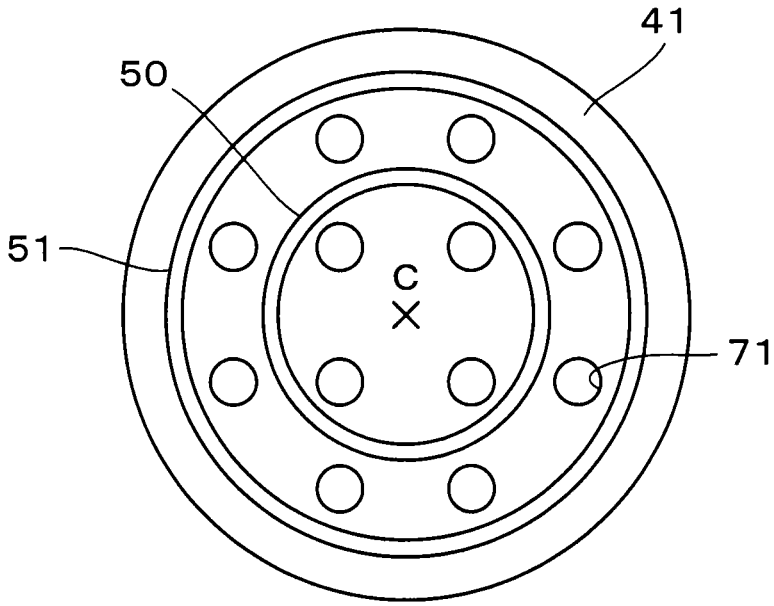
FIG. 7A is a plan view showing the first modification example of an injection hole plate.

FIG. 7A is a plan view showing the first modification example of an injection hole plate. In the first modification example, the number of injection holes 71 formed in the injection hole plate 41 is 12; on the side closer to the center C, four of the injection holes 71 as an inner injection hole group are arranged with a uniform distance from the center C of the injection hole plate 41 in the circumferential direction; eight of the injection holes 71 as an outer injection hole group are arranged on the outer side of the inner injection hole group with a uniform distance from the center C of the injection hole plate 41 in the circumferential direction; an annular recessed portion 50 extending annularly is arranged between the inner injection hole group and the outer injection hole group; and an annular recessed portion 51 is arranged on the outer side of the outer injection hole group.

Second Modification Example

Figure 7B:
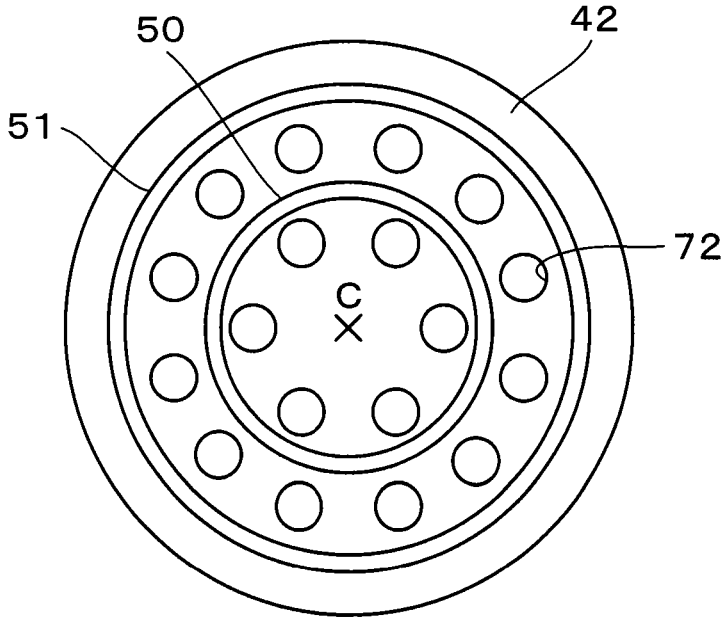
FIG. 7B is a plan view showing the second modification example of an injection hole plate.

FIG. 7B is a plan view showing the second modification example of an injection hole plate. As apparent from FIG. 7B, in the second modification example as compared to the first modification example, the number of the injection holes 72 formed in the injection hole plate 42 is increased to 18. Specifically, the number of the injection holes 72 in the inner injection hole group is set to six and the number of the injection holes 72 in the outer injection hole group is set to 12. As to the recessed portions, as with the first modification example in FIG. 7A, the two annular recessed portions 50, 51 are arranged.

Third Modification Example

Figure 7C:
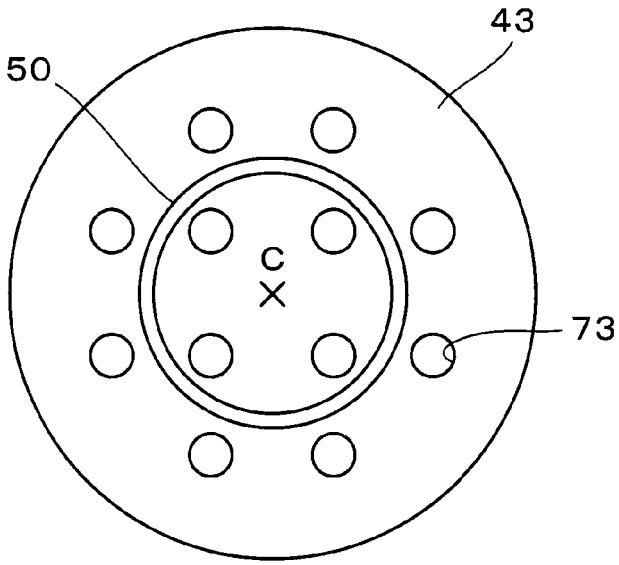
FIG. 7C is a plan view showing the third modification example of an injection hole plate.

FIG. 7C is a plan view showing the third modification example of an injection hole plate. As apparent from FIG. 7C, in the third modification example, the injection holes 73 are arranged in the injection hole plate 43 as with the first modification example. However, as to the recess portion, the annular recessed portion 50 is arranged only between the inner injection hole group and the outer injection hole group in the injection hole plate 43.

Fourth Modification Example

Figure 7D:
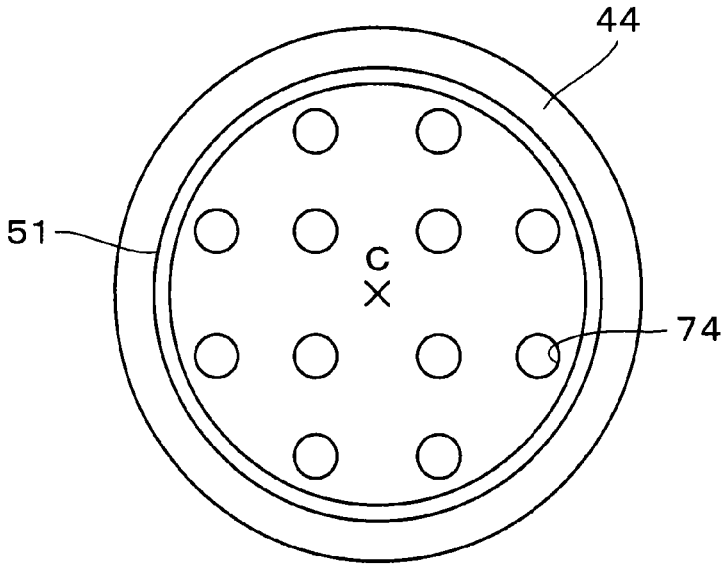
FIG. 7D is a plan view showing the fourth modification example of an injection hole plate.

FIG. 7D is a plan view showing the fourth modification example of an injection hole plate. As apparent from FIG. 7D, in the fourth modification example, injection holes 74 are arranged in the injection hole plate 44 as with in the first modification example. However, as to the recessed portion, the annular recessed portion 51 is arranged only on the outer side of the outer injection hole group in the injection hole plate 44.

In the first to fourth modification examples, since the recessed portion is annularly shaped and surrounds the injection holes, the effect of the recessed portion can be applied to all of the fuel moving toward the injection holes arranged closer to the center than the recessed portion.

Fifth Modification Example

Figure 7E:
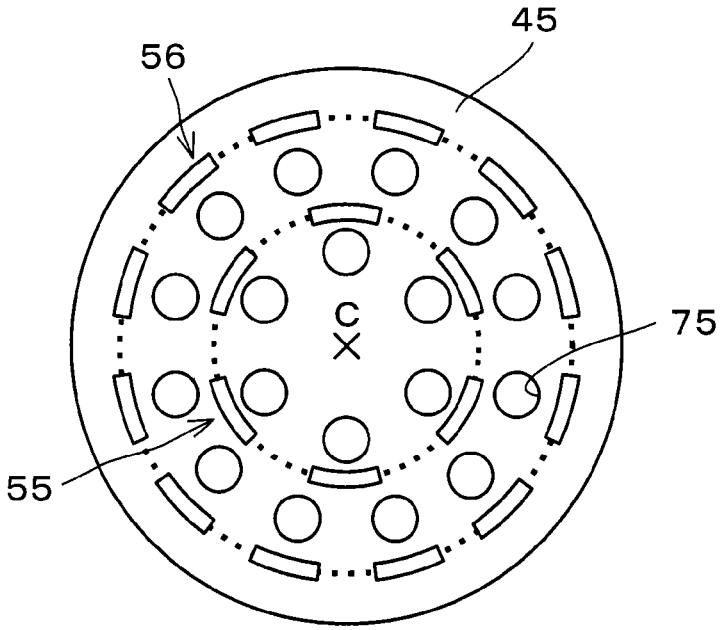
FIG. 7E is a plan view showing the fifth modification example of an injection hole plate.

FIG. 7E is a plan view showing the fifth modification example of an injection hole plate. In the fifth modification example, 12 of injection holes 75 are arranged in the injection hole plate 45 as with the second modification example. However, the shape of the recessed portion is modified. That is, in the fifth modification example, the recessed portion is not annular, and divided recessed portions 55, 56 which intermittently extend in the circumferential direction as opposed to each of the injection holes 75 are arranged between the inner injection hole group and the outer injection hole group, and on the outer side of the outer injection hole group respectively.

Sixth Modification Example

Figure 7F:
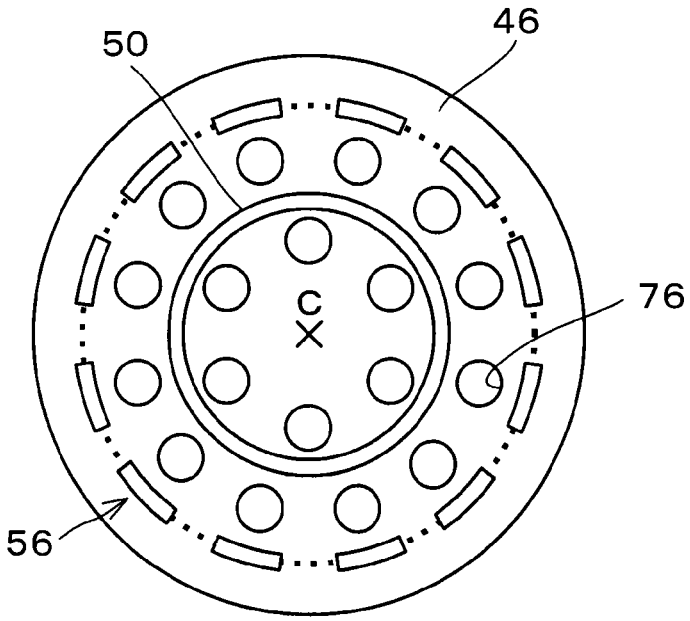
FIG. 7F is a plan view showing the sixth modification example of an injection hole plate.

FIG. 7F is a plan view showing the sixth modification example of an injection hole plate. Although the sixth modification example is similar to the fifth modification example, the sixth modification example is different from the fifth modification example in that the recessed portion arranged between the inner injection hole group and the outer injection hole group is the annular recessed portion 50 as with the first modification example, and the annular recessed portion 50 is formed in the injection hole plate 46. The number and arrangement of the injection holes 76 are the same as those in the fifth modification example.

According to the fifth and the sixth modification examples, since the divided recessed portion 56 arranged on the outer side of the outer injection hole group are divided at positions represented by broken lines except for portions opposed to each injection hole in the outer injection hole group, fuel led by the inner injection hole group passes through the divided portions and reaches the inner injection hole group through the divided recessed portion 55 or the annular recessed portion 50 without being affected by the divided recessed portion 56. Accordingly, since the effect of fuel atomization by the inner injection hole group is not less degraded than the effect by the outer injection hole group, the atomization effects of the inner injection hole group and the outer injection hole group can be made uniform.

Seventh Modification Example

Figure 7G:
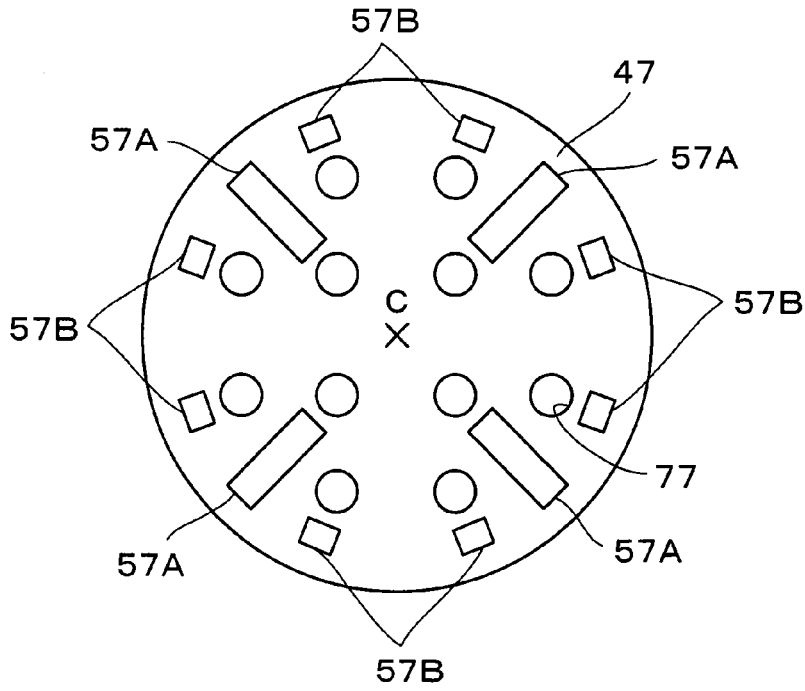
FIG. 7G is a plan view showing the seventh modification example of an injection hole plate.

FIG. 7G is a plan view showing the seventh modification example of an injection hole plate. In the seventh modification example, as with the first modification example, 12 injection holes 77 are formed in the injection hole plate 47, an elongated first recessed portion 57A is arranged in the injection hole plate 47 so as to be adjacent to each of the injection holes 77 included in the inner injection hole group, and a second recessed portion 57B is arranged in the injection hole plate 47 so as to be adjacent to each of the injection holes 77 included in the outer injection hole group. Each of the recessed portions 57A, 57B is oriented to the center C of the injection hole plate 47. Since each of the recessed portions 57A, 57B is oriented to the center C, the effects by the recessed portions 57A, 57B can be equally applied to each of the injection holes 77 formed in the injection hole plate 47. Since the first recessed portion 57A adjacent to each of the injection holes 77 in the inner injection hole group is shaped like an elongated rectangle having a longer radial length than a width in the circumferential direction of the injection hole plate 47, it is possible to lead efficiently fuel into each of the injection holes 77 in the inner injection hole group existing away from the valve sheet.

Eighth Modification Example

Figure 7H:
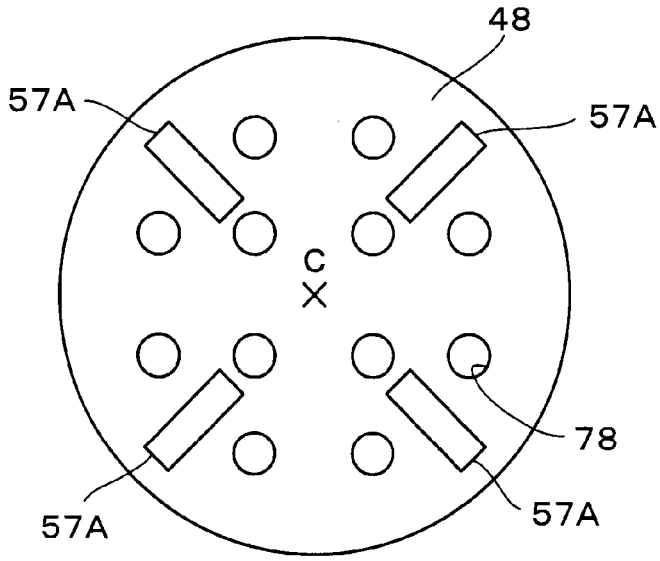
FIG. 7H is a plan view showing the eighth modification example of an injection hole plate.

FIG. 7H is a plan view showing the eighth modification example of the injection hole plate. The eighth modification example is obtained by omitting the second recessed portions 57B adjacent to the outer injection hole group from the seventh modification example and forming the first recessed portions 57A adjacent to the inner injection hole group in the injection hole plate 48. The number and arrangement of the injection holes 78 are the same as those in the seventh modification example.

Ninth Modification Example

Figure 7I:
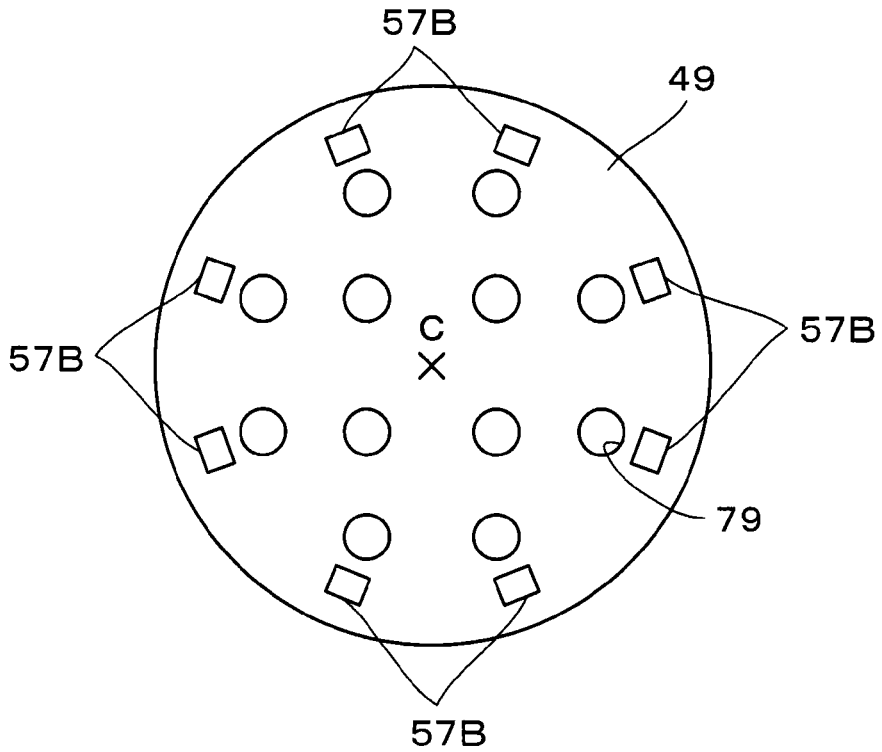
FIG. 7I is a plan view showing the ninth modification example of an injection hole plate.

FIG. 7I is a plan view showing the ninth modification example of an injection hole plate. The ninth modification example is obtained by omitting the first recessed portions 57A adjacent to the inner injection hole group from the seventh modification example and forming the second recessed portions 57B adjacent to the outer injection hole group in the injection hole plate 49. The number and arrangement of the injection holes 79 are the same as those in the seventh modification example. The eighth and the ninth modification examples can perform the same effect as the seventh modification example.

Figure 8:
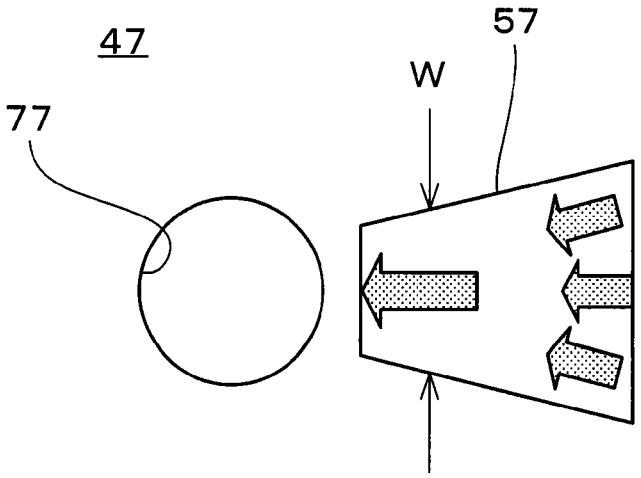
FIG. 8 is an explanatory view illustrating another shape of a recessed portion shown in FIG. 7G.

In the seventh to the ninth modification examples including the non-annular recessed portions, as shown in FIG. 8, the recessed portion 57 may be shaped such that the width with respect to a circumferential direction of the injection hole plate 47 is gradually smaller as getting closer to the injection hole 77. In this case, since the fuel entering the recessed portion 57 is gradually narrowed toward the injection hole as represented by an arrow, the fuel flow toward the injection hole 77 can be enforced. This increases a force of pressing the fuel onto the inner wall surface of the injection hole 77, which contributes to fuel thinning.

Figure 9:
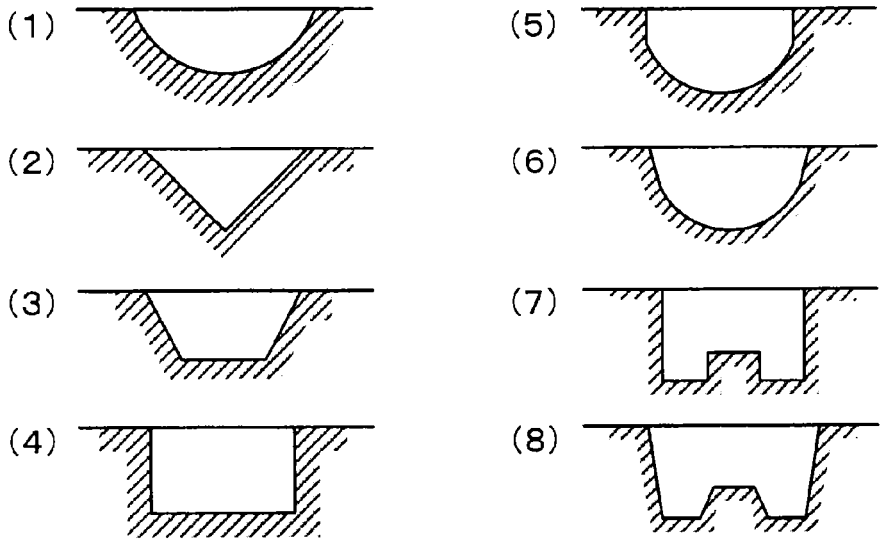
FIG. 9 is an explanatory view showing variations of the shape of the cross section of the recessed portion shown in FIG. 7G.

Further in the seventh to the ninth modification examples including the non-annular recessed portions, the shape of the cross section of the recessed portion 57, which is orthogonal to the radial direction of the injection hole plate, can be variously modified as shown in (1) to (8) in FIG. 9. FIG. 9 shows possible shapes of the cross section of the recessed portion 57 as follows: (1) arc, (2) triangle, (3) trapezoid, (4) rectangle, (5) combination of rectangle and arc, (6) combination of trapezoid and arc, (7) protrusion portion formed in the bottom of rectangle and (8) protrusion portion formed in the bottom of trapezoid. In any shape shown in FIG. 9, cornered portions or angled portions may be rounded.

(2) Modification Examples of Cross-Sectional Shape of Recessed Portion

In each of the first to the third embodiments, although the shape of the cross-section of the recessed portion, which is parallel with the fuel flow direction (radial direction) and is perpendicular to the injection hole plate, is trapezoid having a flat bottom as shown in FIG. 2, this is merely an example. As long as the fuel flow direction toward the injection holes can be changed such that after passing through the valve sheet, the fuel descends lower than a height of an inlet ports of the injection holes on the injection hole plate and then, turns to ascension and reaches the inlet ports of the injection holes, the recessed portion may be varied as described below.

First Modification Example

Figure 10A:
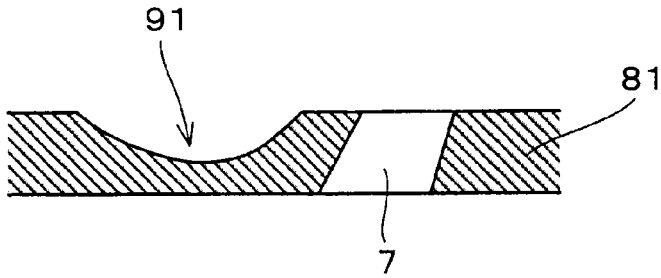
FIG. 10A is an enlarged sectional view showing the first modification example of a recessed portion.

FIG. 10A is an enlarged sectional view showing the first modification example of a recessed portion. In the first modification example, a recessed portion 91 is formed in an injection hole plate 81, and the shape of cross section of the recessed portion 91 is arcuate. The arcuate portion may be apart of a circle, a part of an ellipse, a part of other curve or combination of them.

Second Modification Example

Figure 10B:
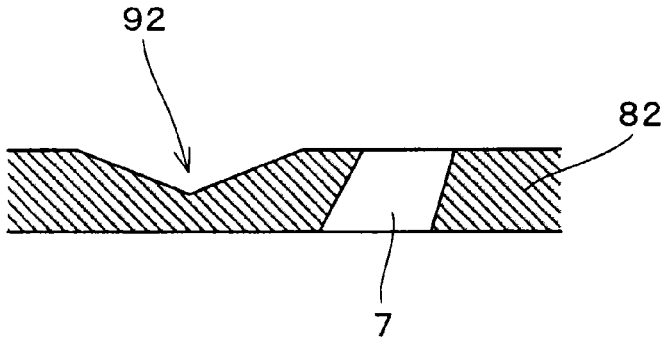
FIG. 10B is an enlarged sectional view showing the second modification example of a recessed portion.

FIG. 10B is an enlarged sectional view showing Second modification example of a recessed portion. In the second modification example, a recessed portion 92 is formed in an injection hole plate 82, and the shape of cross section of the recessed portion 92 is triangular. In this case, cornered portions or angled portions of the recessed portion 92 may be rounded.

(3) Modification Examples of Straight Portion

In the first to the third embodiments, the straight portion is provided between the recessed portion and the injection holes. The existence/absence of the straight portion and the shape of the straight portion when viewed from the axial direction are optional and below-described variations are available.

First Modification Example

Figure 11A:
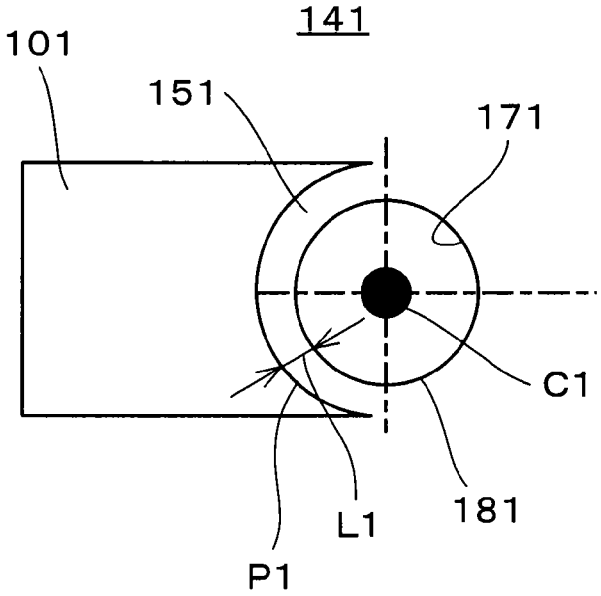
FIG. 11A is an enlarged sectional view showing the first modification example of a straight portion.

FIG. 11A is a plan view showing the first modification example of the straight portion. A recessed portion 101 according to this modification example is formed in an injection hole plate 141 such that a contour P1 on a side of an injection hole 171 formed between an upper surface of the injection hole plate 141 and the recessed portion 101 conforms with an inlet port 181 of the injection hole 171. In the first modification example, a length L1 of a straight portion 151 is uniform with respect to the circumferential direction of the inlet port 181. That is, the center C1 that provides the contour P matches the center of the injection hole 171.

Second Modification Example

Figure 11B:
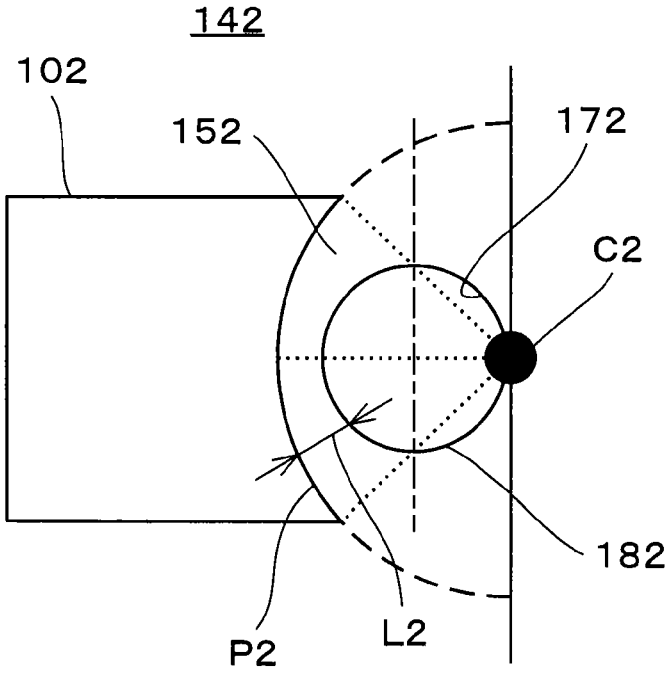
FIG. 11B is an enlarged sectional view showing the second modification example of the straight portion.

FIG. 11B is a plan view showing the second modification example with respect to the straight portion. A recessed portion 102 according to this modification example, as with the first modification example, is formed in an injection hole plate 142 such that a contour P2 on the side of an injection hole 172 formed between an upper surface of the injection hole plate 142 and the recessed portion 102 conforms to an inlet port 182 of the injection hole 172. In the second modification example, a length L2 of a straight portion 152 is varied so as to be maximum at both ends and be minimum at the center with respect to a circumferential direction. In order to vary the length L2 of the straight portion 142 in this manner, the recessed portion 102 is formed such that the center C2 providing the contour P2 is located on a wall surface opposed to the injection hole 172.

In both of the first and the second modification examples, since the contour of the recessed portion is configured to conform to the inlet port of the injection hole, when the fuel having passed through the recessed portion reaches the inlet port of the injection holes, the conditions with respect to the circumferential direction of the injection hole are almost same, and it is ensured that the fuel can be peeled.

Third Modification Example

Figure 11C:
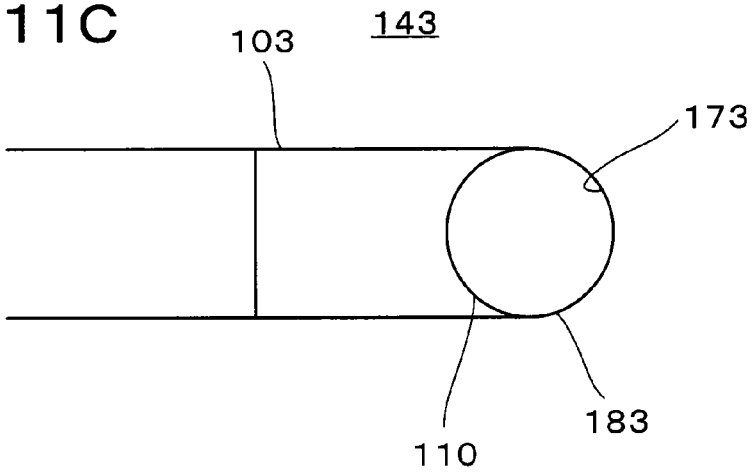
FIG. 11C is an enlarged sectional view showing the third modification example of the straight portion.
Figure 12:
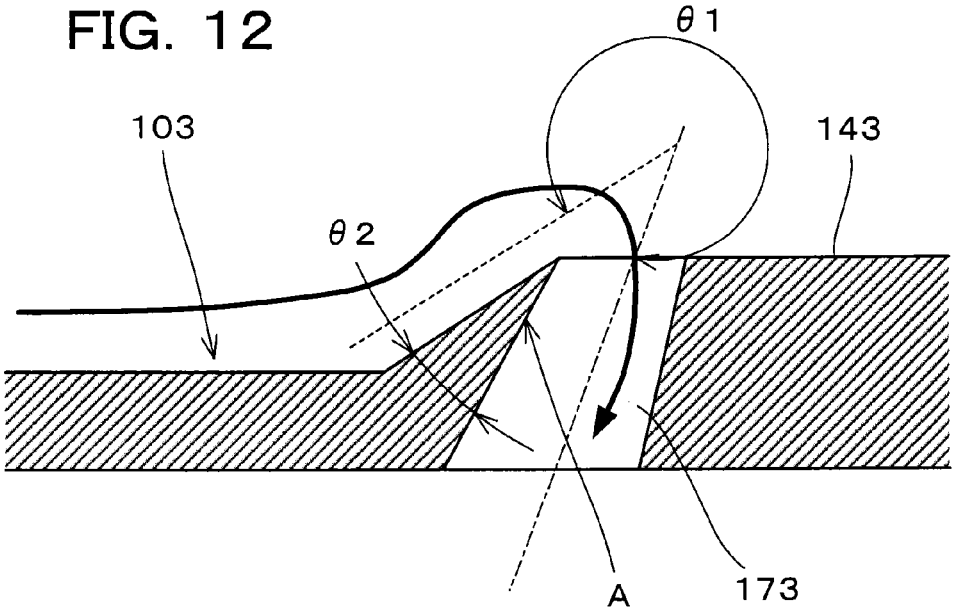
FIG. 12 is an explanatory view illustrating the effect of the modification example shown in FIG. 11C.

FIG. 11C is a plan view showing the third modification example of the straight portion. This modification example is characterized by that, in order to eliminate the straight portion, a recessed portion 103 is formed in an injection hole plate 143 such that a boundary portion 110 between an upper surface of the injection hole plate 143 and the recessed portion 103 overlaps an inlet port 183 of an injection hole 173. In this modification example, as shown in FIG. 12, since a portion A where fuel peeling occurs becomes acute, that is, a peeling angle θ1 becomes large and an angle of the portion A θ2 becomes acute, fuel peeling is enhanced and fuel atomization is further improved.

(4) Other Modification Examples

Figure 13A:
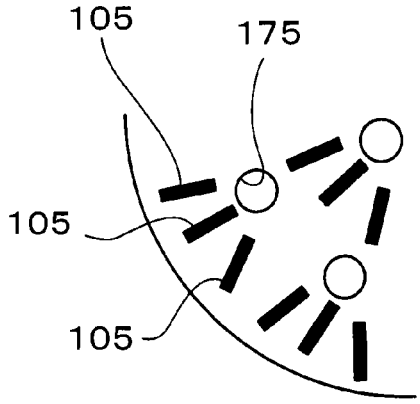
FIG. 13A is an explanatory view showing the first example in which a plurality of recessed portions are provided with respect to one injection hole.
Figure 13B:
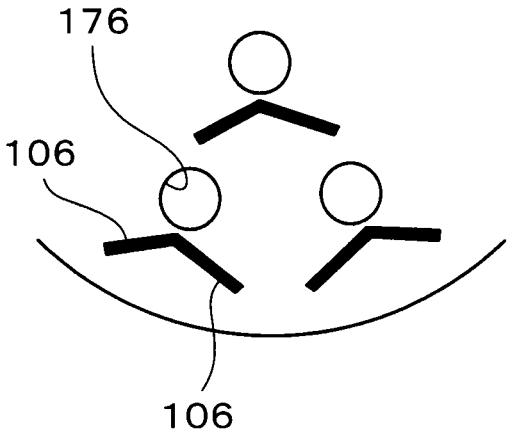
FIG. 13B is an explanatory view showing the second example in which a plurality of recessed portions are provided with respect to one injection hole.

The present invention is not limited to the case where one recessed portion is provided with respect to one injection hole, and a plurality of recessed portions may be provided with respect to one injection hole. FIG. 13A is an explanatory view showing the first example in which a plurality of recessed portions are provided with respect to one injection hole. In this first example, a plurality of (three in this figure) recessed portions 105 are provided with respect to one injection hole 175, and each of the recessed portions 105 extends toward the injection hole 175. FIG. 13B is an explanatory view showing the second example in which a plurality of recessed portions are provided with respect to one injection hole. In the second example, the plurality of (two in this figure) recessed portions 106 are provided with respect to one injection hole 176 so as to extend toward the injection hole, and the recessed portions 106 are connected to each other on the side closer to the injection hole 176. In each of the examples shown in FIGS. 13A and 13B, fuel that does not flow toward the inlet port of the injection holes can be collected into the injection holes by the plurality of recessed portions. Because of this, fuel can be efficiently jetted.

The orientation of the injection holes formed in the injection hole plate is not necessarily inclined relatively to the fuel advancing direction. The inclination angle α shown in FIG. 2 may be 0, that is, the injection holes may be formed perpendicular to the injection hole plate.

The invention claimed is:

1. A fuel injection valve including: a needle housed in a valve body in a reciprocable manner; an injection hole plate attached to a front end portion of the valve body, the injection hole plate having at least one injection hole connecting an inside and an outside of the valve body; and a valve sheet which the needle is attached to or detached from so as to close or open a fuel flow path that reaches the injection hole in the injection hole plate through an outer circumference of the needle, wherein the injection hole plate has a recessed portion dented in an axial direction of the needle so as to cause fuel flowing toward the injection hole through the valve sheet to descend lower than a height of an inlet port of the injection hole and then, to turn to ascension so as to reach the inlet port of the injection hole on the injection hole plate, wherein the injection hole plate has the injection hole at a position separated from a center outward in the radial direction with respect to the injection hole plate, and an upstream side of the injection hole partially cut out for the inlet port of the injection hole to have a difference of altitude with respect to a normal direction of the injection hole plate having the injection hole such that a side closer to the center is lower than a side further from the center.

2. The fuel injection valve according to claim 1, wherein the difference of altitude is given by forming on the injection hole plate a groove leading to the injection hole on the side closer to the center.

3. The fuel injection valve according to claim 1, wherein the recessed portion is arranged such that a boundary portion between an upper surface of the injection hole plate and the recessed portion is located on an extension of a contact surface between the valve sheet and the needle.

4. The fuel injection valve according to claim 3, wherein the recessed portion has a side wall surface that connects the boundary portion to a bottom portion, and the contact surface and the side wall surface have the same inclination as each other.

5. The fuel injection valve according to claim 1, wherein the recessed portion and the injection hole are arranged in the injection hole plate with a predetermined distance therebetween, and thereby a straight portion is formed between the recessed portion and the injection hole.

6. The fuel injection valve according to claim 1, wherein the injection hole plate has a plurality of injection holes, and the recessed portion extends in the circumferential direction of the injection hole plate so as to surround the plurality of injection holes.

7. The fuel injection valve according to claim 1, wherein the injection hole plate has an inner injection hole group where a plurality of injection holes are arranged in the circumference direction of the injection hole plate and an outer injection hole group where a plurality of injection holes are arranged on an outer side of the inner injection hole group in the circumference direction, and first divided recessed portions and second divided recessed portions are provided as the recessed portion, wherein the first divided recessed portions are arranged between the inner injection hole group and the outer injection hole group so as to extend in the circumferential direction of the injection hole plate, the first divided recessed portions intermittently extending in the circumferential direction while facing the injection holes in the inner injection hole group respectively, and the second divided recessed portions are arranged on an outer side of the outer injection hole group, the second divided recessed portions intermittently extending in the circumferential direction facing the injection holes in the outer injection hole group respectively.

8. The fuel injection valve according to claim 1, wherein the injection hole plate has an inner injection hole group where a plurality of injection holes are arranged in the circumference direction of the injection hole plate and an outer injection hole group where a plurality of injection holes are arranged on an outer side of the inner injection hole group in the circumference direction, and as the recessed portion, an annular recessed portion is arranged between the inner injection hole group and the outer injection hole group so as to extend the circumference direction of the injection hole plate, and also divided recessed portions are arranged on an outer side of the outer injection hole group, the divided recessed portions intermittently extending in the circumferential direction facing the injection holes respectively.

9. The fuel injection valve according to claim 1, wherein the injection hole plate has a plurality of injection holes, and the recessed portion is arranged adjacent to each of the injection holes and is oriented to the center of the injection hole plate.

10. The fuel injection valve according to claim 1, wherein the recessed portion extends toward the center of the injection hole plate so as to have a larger radial length than a width in the circumferential direction of the injection hole plate.

11. The fuel injection valve according to claim 1, wherein a protrusion portion is formed on the needle, the protrusion portion facing the recessed portion and protruding on a side where the protrusion portion comes close to the recessed portion.

12. The fuel injection valve according to claim 11, wherein the protrusion portion has the same shape as the facing recessed portion.

13. The fuel injection valve according to claim 1, wherein the recessed portion is formed in the injection hole plate such that a contour of the recessed portion on a side of the injection hole formed between the recessed portion and the upper surface of the injection hole plate is provided along an inlet port of the injection hole.

14. The fuel injection valve according to claim 1, wherein the recessed portion is formed in the injection hole plate such that a width with respect to the circumferential direction of the injection hole plate is gradually smaller as the width gets closer to the injection hole.

15. The fuel injection valve according to claim 1, wherein a plurality of recessed portions with respect to one injection hole are formed in the injection hole plate, and each of the plurality of recessed portions extends toward the injection holes.

16. The fuel injection valve according to claim 15, wherein the plurality of recessed portions are connected to each other on a side closer to the injection hole.

17. The fuel injection valve according to claim 1, wherein the recessed portion is formed in the injection hole plate such that a boundary portion between an upper surface of the injection hole plate and the recessed portion overlap the inlet port of the injection hole.

* * * * *